US010758453B1

(12) United States Patent
Feagle

(10) Patent No.: US 10,758,453 B1
(45) Date of Patent: Sep. 1, 2020

(54) QUADRIPLEGIC AND PARAPLEGIC PATIENT HYDROTHERAPY STANDING SUPPORT IMMERSION APPARATUS

(71) Applicant: Teresa Feagle, Lakeland, FL (US)

(72) Inventor: Teresa Feagle, Lakeland, FL (US)

( * ) Notice: Subject to any disclaimer, the term of this patent is extended or adjusted under 35 U.S.C. 154(b) by 1213 days.

(21) Appl. No.: 14/616,959

(22) Filed: Feb. 9, 2015

(51) Int. Cl.
*A61H 33/00* (2006.01)

(52) U.S. Cl.
CPC ..... *A61H 33/60* (2013.01)

(58) Field of Classification Search
CPC ..... A61H 1/0292; A61H 2203/0412; A61H 2203/0443; A61H 2203/045; A61H 3/008; A61H 3/04; A61H 2003/046; A61H 2201/0149; A61H 2201/1602; A61H 2201/1623; A61H 2201/164; A61H 2201/1652; A61H 2201/16; A61H 2201/1621; A61H 9/00; A61G 2005/0866; A61G 2005/1027; A61G 2005/1094; A61G 2005/127; A61G 5/1005; A61G 5/14; A61G 5/1089; A61G 2200/38; A63B 2208/0214; A63B 23/035; A63B 21/0084; A63B 21/008; A43B 5/08; A61F 5/042
USPC ..... 128/845; 601/154, 158, 160, 166; 297/423.1, 172; 135/67
See application file for complete search history.

(56) References Cited

U.S. PATENT DOCUMENTS 4,809,997 A * 3/1989 Owens ..... A61G 5/1089 280/211
5,230,106 A * 7/1993 Henkin ..... A61H 33/0087 4/541.4
5,411,044 A * 5/1995 Andolfi ..... A61G 7/1019 135/66
5,813,948 A * 9/1998 Quigg ..... A61H 3/04 280/87.041
5,884,935 A * 3/1999 Tholkes ..... A61G 5/14 280/650
6,440,046 B1 * 8/2002 Tholkes ..... A61G 5/14 280/250.1
8,419,599 B2 * 4/2013 Seol ..... A43B 5/08 441/129

(Continued)

*Primary Examiner* — Keri J Nelson
*Assistant Examiner* — Adam Baker
(74) *Attorney, Agent, or Firm* — Williams Intellectual Property; Benjamin F. Williams

(57) ABSTRACT

A quadriplegic and paraplegic patient hydrotherapy standing support immersion apparatus that includes a first vertical support frame and a second vertical support frame disposed atop a base frame, said first and second vertical support frames connectable around a patient disposed upstanding therein, wherein a leg support conformably engages against said patient's legs proximal said patient's knees, a sternal support conformally engages against the chest of said patient, a posterior support member ergonomically engages against the length of said patient's back, and a shoulder support member engages an arched portion over each of said patient's shoulders and a breast support portion against the upper breast of said patient, whereby said patient is supportable maintained upstanding for immersion in a water body and thereby subject to therapeutic benefits of hydrotherapy and other physical therapy to resist muscle deterioration and problems of inhibited circulation resultant is from maintaining a supine posture for extended periods.

9 Claims, 3 Drawing Sheets

(56) References Cited

U.S. PATENT DOCUMENTS 8,522,907 B1 * 9/2013 Irvine ..... A61G 5/14
135/66

* cited by examiner

QUADRIPLEGIC AND PARAPLEGIC PATIENT HYDROTHERAPY STANDING SUPPORT IMMERSION APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of quadriplegic and paraplegic patient hydrotherapy and physical therapy apparatuses are known in the prior art. However, what is needed is a buoyancy controlled quadriplegic and paraplegic patient hydrotherapy standing support immersion apparatus that includes a first vertical support frame and a second vertical support frame disposed atop a base frame, said first and second vertical support frames connectable around a patient disposed upstanding therein, wherein a leg support conformably engages against said patient's legs proximal said patient's knees, a sternal support conformally engages against the chest of said patient, a posterior support member ergonomically engages against the length of said patient's back, and a shoulder support member engages an arched portion over each of said patient's shoulders and a breast support portion against the upper breast of said patient, whereby said patient is supportable maintained upstanding for immersion in a water body and thereby subject to therapeutic benefits of hydrotherapy and other physical therapy to resist muscle deterioration and problems of inhibited circulation.

FIELD OF THE INVENTION

The present invention relates to a quadriplegic and paraplegic patient hydrotherapy standing support immersion apparatus, and more particularly, to a buoyancy controlled quadriplegic and paraplegic patient hydrotherapy standing support immersion apparatus that includes a first vertical support frame and a second vertical support frame disposed atop a base frame, said first and second vertical support frames connectable around a patient disposed upstanding therein, wherein a leg support conformably engages against said patient's legs proximal said patient's knees, a sternal support conformally engages against the chest of said patient, a posterior support member ergonomically engages against the length of said patient's back, and a shoulder support member engages an arched portion over each of said patient's shoulders and a breast support portion against the upper breast of said patient, whereby said patient is supportable maintained upstanding for immersion in a water body and thereby subject to therapeutic benefits of hydrotherapy and other physical therapy to resist muscle deterioration and problems of inhibited circulation.

SUMMARY OF THE INVENTION

The general purpose of the quadriplegic and paraplegic patient hydrotherapy standing support immersion apparatus, described subsequently in greater detail, is to provide a quadriplegic and paraplegic patient hydrotherapy standing support immersion apparatus which has many novel features that result in a quadriplegic and paraplegic patient hydrotherapy standing support immersion apparatus which is not anticipated, rendered obvious, suggested, or even implied by prior art, either alone or in combination thereof.

The present quadriplegic and paraplegic patient hydrotherapy standing support immersion apparatus has been devised to enable quadriplegic and paraplegic patients supported upstanding for immersion in a water body for hydrotherapy therein. Buoyancy assists supporting a patient, and hydrotherapy can be beneficial for treating muscle deterioration and circulatory inhibition resultant from a maintained supine position over extended periods. Further, the buoyancy force from fluid immersion can assist physical therapy for paraplegic patients and other patients overcoming spinal cord and other motor coordination injuries.

The present quadriplegic and paraplegic patient hydrotherapy standing support immersion apparatus, therefore, includes a first vertical support frame disposed upon a is base frame, said first vertical support frame disposed to conformably engage against basal portions of a patient's body, and a second vertical support frame pivotally securable to the first vertical support frame, said second vertical support frame disposed to conformably engage against dorsal portions of a patient's body, whereby a patient is supportable upstanding between said first and second vertical support frames without having to maintain musculature control of said patient's legs or torso.

Once supportively engaged between the first and second vertical support frames, a patient is positional into a water body for immersion. The present quadriplegic and paraplegic patient hydrotherapy standing support immersion apparatus may be weighted appropriately to remain negative buoyancy of a base frame and positive buoyancy of a shoulder support member during use, whereby a patient is supported upstanding in a water body without risk of displacement by action of the fluid thereabouts and said patient's head is maintained above any water surface. To move the apparatus, a first and second pair of wheels are disposed upon the base frame, whereby a patient supported upstanding in the apparatus is volubly positional, as desired, within and without an appropriate water body.

Negative buoyancy of the base frame may be adjustable by addition or subtraction of weights thereto. Positive buoyancy of the shoulder support member may be adjustable by increased or decreased inflation of arched portions and a breast support portion thereof, as case may be, whereby buoyancy control is enabled to maintain correct alignment of the apparatus when used immersed in an appropriate water body.

A patient is disposed atop the base frame by securement of each of said is patient's feet into each of a pair of foot supports. Each foot support is securable in position along the length of an underlying parallel frame member comprising the base frame. Each of the pair of foot supports includes a securement member whereby each of the patient's feet is securable atop each foot support.

To maintain support for a patient's legs, a leg support is disposed upon the first vertical frame support, said leg support moveable between a horizontal position and a vertical position for directed engagement against a patient's legs. The leg support is conformable and yielding, whereby engagement against the patient's legs is maintainable without injury rendered thereto. In an example embodiment herein disclosed, the leg support is dispositional to engage against a patient's legs proximal the knees, against said patient's thighs.

A padded sternal support is disposed upon the first vertical support frame for engagement against a patient's chest proximal said patients sternum. The sternal support likewise engages against the patient conformably to prevent injury during extended use. The sternal support engages against the patient's chest to support the patient's torso against a posterior support member, disposed conformably engaged against the patient's back, as will be described subsequently. Thus the first vertical support frame engages against basal portions of the patient's body to maintain said patient upstanding thereby.

The second vertical support frame includes a posterior support member disposed to engage against the length of a patient's back when the second vertical support frame is secured in the upright position. The posterior support member may be ergonomically configured to support the curvature of a patient's spine, and supportively uphold the is patient's torso in conjunction with the sternal support disposed upon the first vertical support frame. A patient's torso is thus engaged between the first and second vertical support frames by the sternal support and the posterior support member, and the patients legs are stabilized by the leg support engaging the users legs proximal the knees.

A positional shoulder support member is disposed extendibly upon the second vertical support frame, positional to arch over a patient's shoulders and engage against said patient's shoulders and upper breast. The shoulder support member includes a pair of arched portions for engagement over each of the patient's shoulders, and a breast support portion disposed to engage against the upper breast of a patient therein disposed. Thus the shoulder support member is positional to secure the upper body of a patient between the first and second vertical support frames.

Thus has been broadly outlined the more important features of the present quadriplegic and paraplegic patient hydrotherapy standing support immersion apparatus so that the detailed description thereof that follows may be better understood and in order that the present contribution to the art may be better appreciated.

Objects of the present quadriplegic and paraplegic patient hydrotherapy standing support immersion apparatus, along with various novel features that characterize the invention are particularly pointed out in the claims forming a part of this disclosure. For better understanding of the quadriplegic and paraplegic patient hydrotherapy standing support immersion apparatus, its operating advantages and specific objects attained by its uses, refer to the accompanying drawings and description.

BRIEF DESCRIPTION OF THE DRAWINGS

FIGURES

Figure 1:
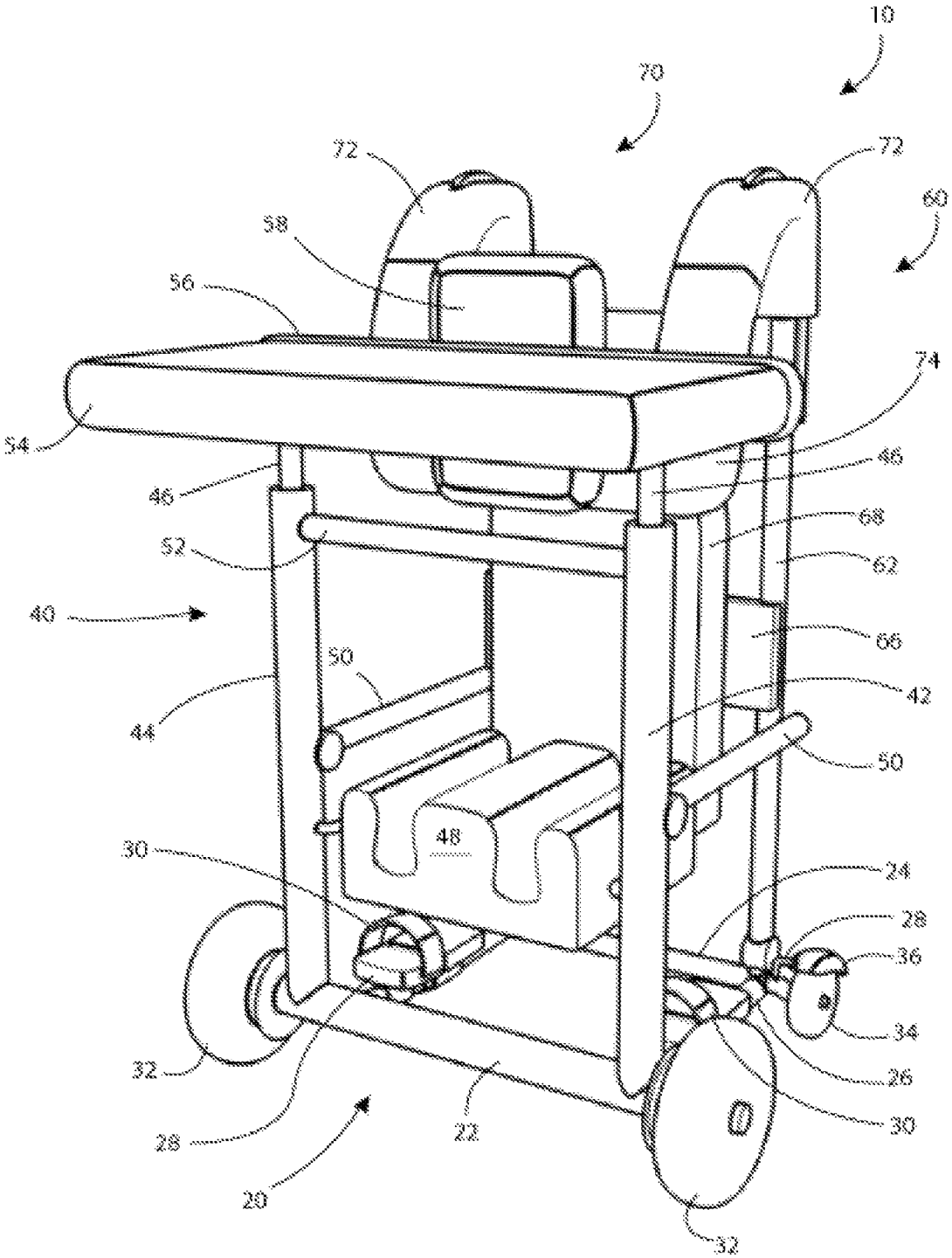

FIG. 1 is an isometric front angled view of an example embodiment with a second vertical support frame disposed in an upright position connected to a first vertical support frame of supportively maintaining a quadriplegic or paraplegic patient upstanding for immersion in a water body.

Figure 2:
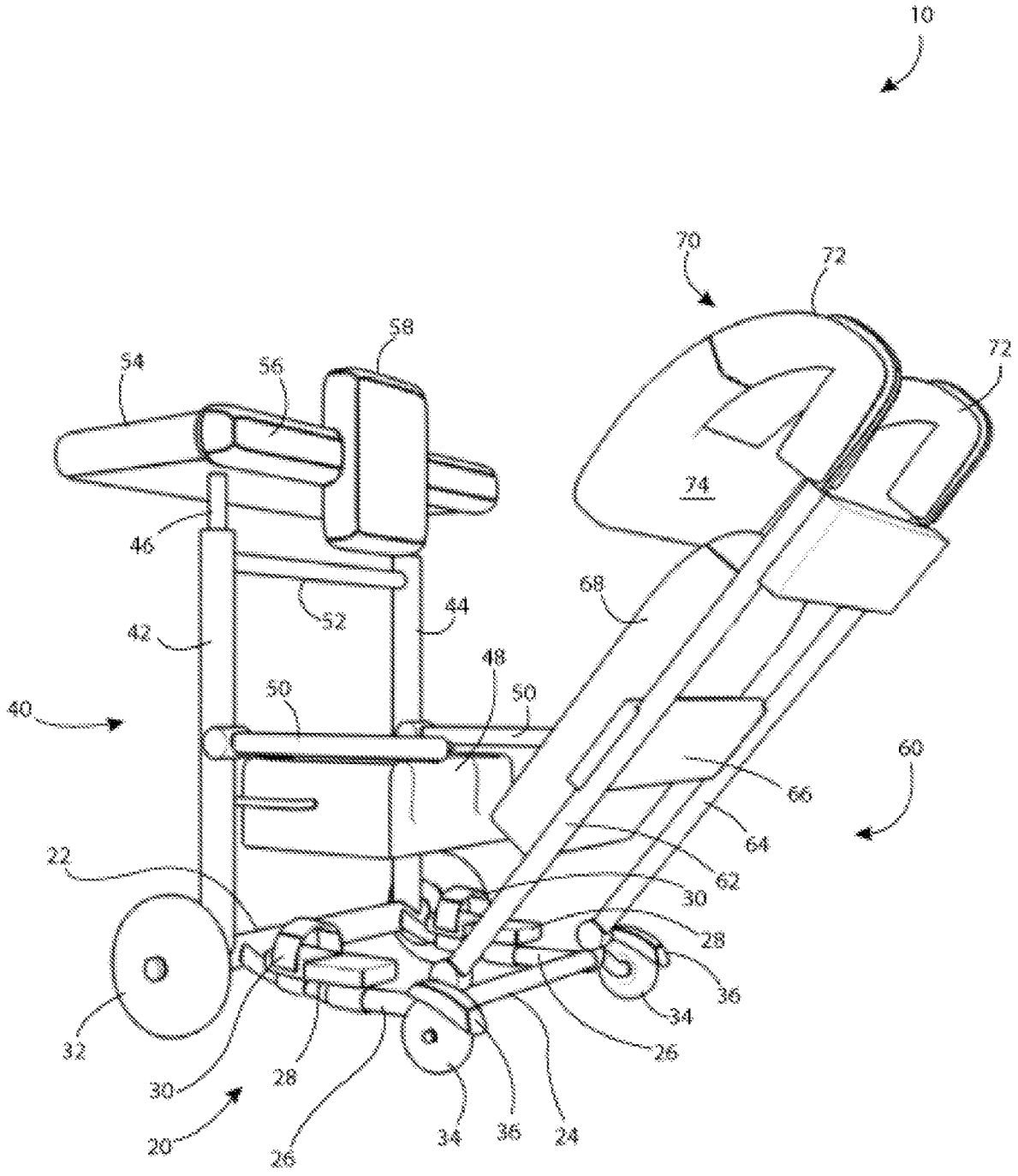

FIG. 2 is an isometric side angled view of an example embodiment with the second vertical support frame disposed disconnected from the first vertical support frame.

Figure 3:
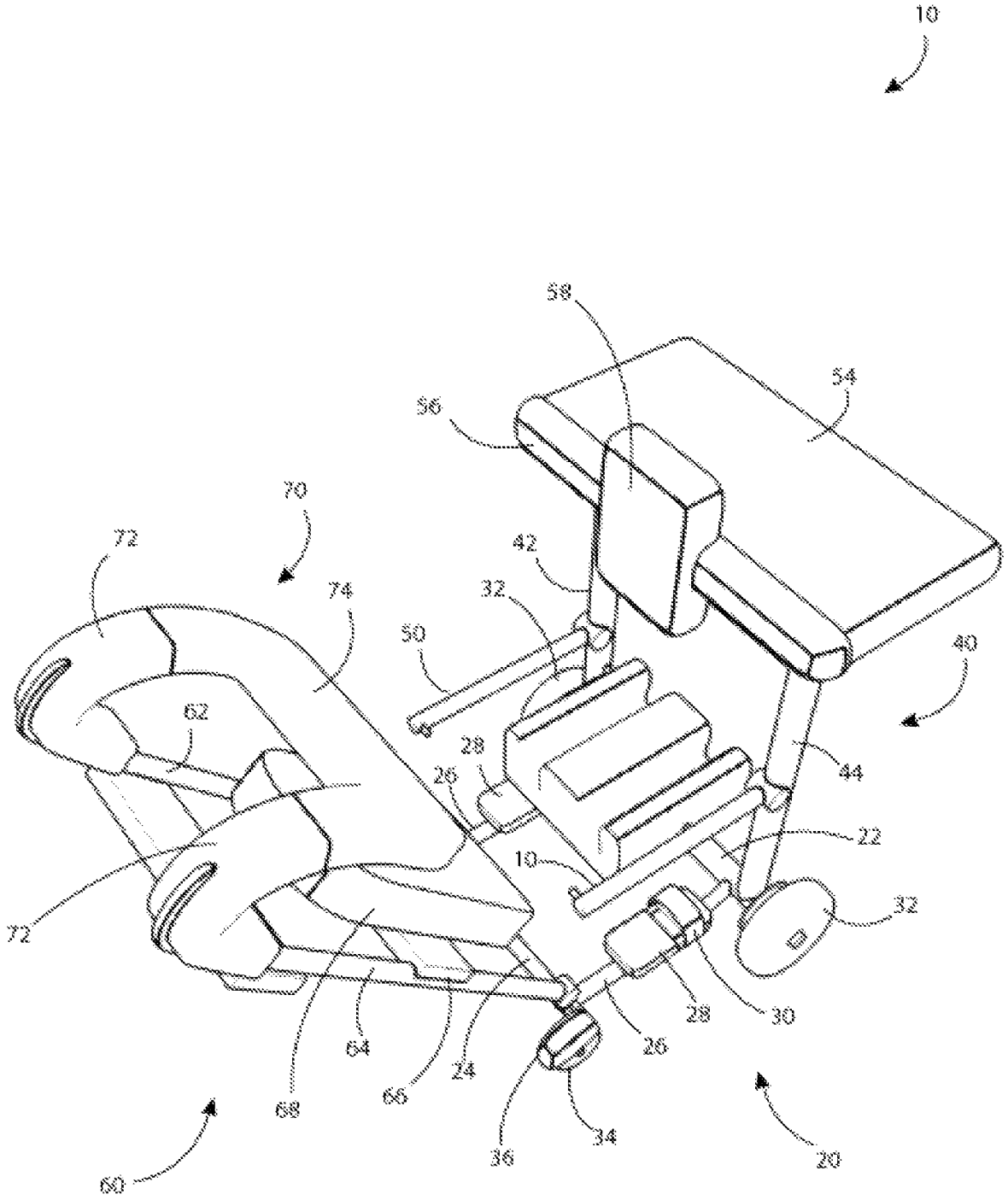

FIG. 3 is an elevation view of an example embodiment with the second vertical support frame disposed disconnected from the first vertical support frame.

DETAILED DESCRIPTION OF THE DRAWINGS

With reference now to the drawings, and in particular FIGS. 1 through 3 thereof, example of the instant quadriplegic and paraplegic patient hydrotherapy standing support immersion apparatus employing the principles and concepts of the present quadriplegic and paraplegic patient hydrotherapy standing support immersion apparatus and generally designated by the reference number 10 will be described.

Referring to FIGS. 1 through 3 a preferred embodiment of the present quadriplegic and paraplegic patient hydrotherapy standing support immersion apparatus 10 is illustrated.

The present quadriplegic and paraplegic patient hydrotherapy standing support immersion apparatus 10 has been devised to supportively uphold a quadriplegic or paraplegic patient upstanding in a water body, while maintaining said patient's head above a water surface, whereby said patient may enjoy the therapeutic benefits of upright posture, buoyancy, and hydrotherapy.

The present quadriplegic and paraplegic patient hydrotherapy standing support immersion apparatus 10, therefore, includes a first vertical support frame 40 and a second vertical support frame 60 endwise connected to a base frame 20. The second vertical support frame 60 is pivotally attached to the base frame 20, and thereat moveable between a lowered position and an upright position. When moved to the upright position, the second vertical support frame 60 is connectable to a pair of connect bars 50 disposed horizontally projected from the first vertical support frame 40. A patient is thereby securable bodily erect and upstanding between said first and second vertical support frames 40, 60, as will be described subsequently, and thereby maintainable is an erect posture while submerged into a water body for hydrotherapy therein.

The base frame 20 is disposed most proximal a ground surface and includes a forward frame member 22 disposed parallel and spaced apart from a rearward frame member 24. A pair of parallel frame members 26 is disposed endwise between said forward frame member 22 and said rearward frame member 24. Each of a pair of foot supports 28 is disposed atop each of the pair of parallel frame members 24 of said base frame 20 whereby a patient's feet are securable onto the base frame 20. Each foot support 28 includes a securement body 30 disposed to engage over a foot of a patient securable therein. Each foot support 28 is securable in desired position longitudinally along the length of each parallel frame member 26.

The base frame 20 is voluble and includes each of a pair of first wheels 32 disposed endwise upon the forward frame member 22 and each of a pair of second wheels 34 disposed endwise upon the rearward frame member 24 of the base frame 20.

The present quadriplegic and paraplegic patient hydrotherapy standing support immersion apparatus 10, therefore, is moveable upon the pair of first and second wheels 32, 34, whereby a patient disposed supported between the first and second vertical support frames 40, 60 is moveable upon the base frame 20 and positional, as desired, within and without a water body.

The present quadriplegic and paraplegic patient hydrotherapy standing support immersion apparatus 10 is securable against displacement upon said first and second pairs of wheels 32, 34, by brake members 36 positional to inhibit rotation of at least the second pair of wheels 34 whereby the base frame 20 is prevented from volubility upon a ground surface, as desired.

The first vertical support frame 40 is disposed endwise vertically atop the forward frame member 22 of the base frame 20. The first vertical support frame 40 includes a first vertical member 42 disposed upwardly in parallel with a second vertical member 44. An extensible member 46 is disposed vertically extendible out each first and second is vertical member 42, 44, each said extensible member 46 thereby positional at a desired height extended out each of the first and second vertical members 42, 44.

A leg support 48 is pivotally connected to the first vertical member 42 and the second vertical member 44, said leg support 48 moveable between a horizontal position and a vertical position whereby a patient's legs may be stabilized engaged by the leg support 48 when said patient is disposed supportively upstanding interior to the quadriplegic and paraplegic patient hydrotherapy standing support immersion apparatus 10. The pair of connect bars 50 is disposed pivotally endwise from the first vertical support frame 40 to position rearwardly projecting in a horizontal plane therefrom, each of said pair of connect bars 50 disposed proximal the leg support 48. Each of the pair of connect bars 50 may be longitudinally adjustable to accommodate patient's of different girths.

A central cross support 52 is disposed between the first and second vertical member 42, 44 proximal each extensible member 46 and a planar tray member 54 is disposed horizontally atop each extensible member 46. The planar tray member 54 has a padded edge 56 and a padded sternal support 58 disposed edgewise thereon in position to engage against a basal portion of a patient's chest when said patient is supportively upheld upstanding within the quadriplegic and paraplegic patient hydrotherapy standing support immersion apparatus 10.

The second vertical support frame 60 is pivotally disposed endwise upon the rearward frame member 24 of the base frame 20. The second vertical support frame 60 is thereat moveable between a lowered position and an upright position releasably connectable to each of the pair of connect bars 50. The second vertical support frame 60 includes a third vertical member 62 pivotally disposed endwise upon the base frame 20 proximal the juncture between the rearward frame member 24 and one of the pair of parallel frame members 26, and a fourth vertical member 64 pivotally disposed endwise upon the base frame 20 proximal the juncture between the rearward frame member 24 and the other of the pair of parallel frame members 26.

A planar cross member 66 is vertically disposed between said third and fourth vertical members 62, 64 in a position proximal the height of the leg support 48 when the second vertical support member 60 is moved to the upright position and a posterior support member 68 is disposed upon the planar cross member 66, said posterior support member 68 disposed to supportively contact the back of a patient and conformably support said patient upstanding between the first and second vertical support frames 40, 60 when the second vertical support frame 60 is secured in the upright position to each of the pair of connect bars 50. The posterior support member 68 may be ergonomically configured to accommodate the curvature of a patient's back.

A positional shoulder support member 70 is disposed atop the second vertical support frame 60, said shoulder support 70 extensible and securable to engage over the shoulders of a patient supported upstanding between the first and second vertical support frames 40, 60. The shoulder support member 70 includes an arched portion 72 engageable over each of a patient's shoulders and a breast support portion 74 disposed to conformably engage against the upper breast of a patient. The shoulder support member 70 may be positively buoyant to maintain a patient's head above a water surface during immersion therein, whereby the base frame 20 weights the feet of a user down and the shoulder support member 70 maintains said patient's head above the water surface, whereby horizontal orientation of the instant quadriplegic and paraplegic patient hydrotherapy standing support immersion apparatus 10 in a water body is preventable.

Thus the second vertical support frame 60 releasably secures in the upright position connectable to the first vertical support frame to supportively uphold a quadriplegic or paraplegic patient in an erect position upstanding for immersion in a body of water whereby hydrotherapy is treatable to said patient.

What is claimed is:

1. A quadriplegic and paraplegic patient hydrotherapy standing support immersion apparatus for physical therapy of a patient recovering from a spinal cord injury, said apparatus comprising:

a first vertical support frame disposed anteriorly atop a voluble base frame;

a second vertical support frame disposed pivotally and posteriorly atop said base frame, said second vertical support frame moveable between a lowered position and an upright position, said second vertical support frame securable in the upright position spaced apart from the first vertical support frame;

a leg support pivotally disposed posteriorly facing upon the first vertical support frame in position to engage against the legs of a patient proximal said patient's knees, said leg support disposed supported by the first and second vertical frame members;

a posterior support member disposed anteriorly facing upon the second vertical support frame, said posterior support member disposed to conformably engage against the dorsal portions of a patient's body when disposed supported by the first and second vertical support frames; and a positional shoulder support member disposed atop the second vertical support frame, said shoulder support member positional to engage over the shoulders of a patient supportively upheld between the first and second vertical support frames;

wherein a quadriplegic or paraplegic patient is maintainable in an erect posture upstanding when supportively upheld between the first and second vertical support frames, there engaged at the legs by the leg support, the back by the posterior support member, and the torso by the shoulder support member, whereby said patient is positional immersed in a water body and maintainable in an erect posture therein with said patient's head exposed above a water surface thereby.

2. The quadriplegic and paraplegic patient hydrotherapy standing support immersion apparatus of claim 1 wherein the base frame is negatively buoyant.

3. The quadriplegic and paraplegic patient hydrotherapy standing support immersion apparatus of claim 2 wherein the shoulder support member is positively buoyant, whereby a patient's head is maintainable above a water surface.

4. The quadriplegic and paraplegic patient hydrotherapy standing support immersion apparatus of claim 3 wherein the voluble base frame comprises:

a forward frame member;

a rearward frame member disposed in parallel with the forward frame member;

a pair of parallel frame members disposed endwise between each of the forward frame member and the rearward frame member;

a pair of first wheels disposed endwise upon the forward frame member;

a pair of second wheels disposed endwise upon the rearward frame member;

at least one brake member disposed to inhibit rotation of at least the pair of rearward wheels when said brake member is activated; and each of a pair of foot supports positionally disposed atop each of the pair of parallel frame members disposed for securable engagement with a patient's feet when said patient is supported upstanding between the first and second vertical support frames;

wherein the base frame is arranged in the form of a square and volubility of said base frame is preventable by action of the at least one brake member.

5. The quadriplegic and paraplegic patient hydrotherapy standing support immersion apparatus of claim 4 wherein the first vertical frame member comprises:

a first vertical member disposed endwise perpendicularly upward from the forward frame member;

a second vertical member disposed endwise perpendicularly upward from the forward frame member, said second vertical member disposed spaced apart and parallel the first vertical member;

each of a pair of connect bars pivotally connected to each of the first and second vertical members proximal the leg support, each of said pair of connect bars longitudinally adjustable for securable engagement with the second vertical support frame;

an extensible member disposed extendible upwards out each of the first and second vertical member and securable thereat at a desired extension; and a planar tray member disposed atop each extensible member, said planar tray member including a padded edge disposed facing rearwards and a padded sternal support disposed to conformably engage against the chest of a patient secured upstanding between the first and second vertical support frames;

wherein the padded sternal support and the leg support are positional to conformably engage against the basal portions of a patients body and secure said patient upstanding between the first and second vertical support frames.

6. The quadriplegic and paraplegic patient hydrotherapy standing support immersion apparatus of claim 5 wherein the second vertical support frame comprises:

a third vertical member pivotally disposed endwise connected proximal the juncture of the rearward frame member and one of the pair of parallel frame members of the base frame;

a fourth vertical member pivotally disposed endwise connected proximal the juncture of the rearward frame member and the other of the pair of parallel frame members of the base frame;

a planar cross member disposed vertically oriented between each of the third and fourth vertical members in a position proximally at the height of the leg support when the second vertical support frame is moved to the upright position; and a posterior support member disposed upon the planar cross member facing forwards thereat, said posterior support member disposed to conformably engage against the dorsal portions of a patient's body disposed supported upstanding between the first and second vertical support frames when the second vertical support frame is secured in the upright position;

wherein the posterior support member conformably engages against the dorsal portions of a patent's body to supportively maintain said patient upstanding in concert with the padded sternal support and the leg support disposed upon the first vertical support frame, whereby a quadriplegic or paraplegic patient is positional upstanding for immersion in a water body.

7. A quadriplegic and paraplegic patient hydrotherapy standing support immersion apparatus comprising:

a base frame having a forward frame member disposed parallel a rearward frame member, and a pair of parallel frame members disposed endwise therebetween;

each of a pair of foot supports securably positional longitudinally atop each of the pair of parallel frame members of said base frame;

each of a pair of first wheels disposed endwise upon the forward frame member of the base frame;

each of a pair of second wheels disposed endwise upon the rearward frame member of the base frame;

at least one brake member disposed to inhibit rotation of at least the pair of second wheels when said brake member is activated;

a first vertical support frame disposed endwise vertically atop the forward frame member of the base frame, said first vertical support frame comprising:

a first vertical member;

a second vertical member;

an extensible member disposed extendible vertically upwards out each first and second vertical member;

a central cross support connected between the first and second vertical member proximal each extensible member;

a leg support pivotally connected to the first vertical member and the second vertical member, said leg support moveable between a horizontal position and a vertical position and positional to engage against a patient's legs;

a pair of connect bars pivotally disposed endwise from the first vertical support frame and positional projecting perpendicularly thereform, each of said pair of connect bars disposed proximal the knee support;

a planar tray member disposed horizontally atop each extensible member, said planar tray having a padded edge and a padded sternal support disposed edgewise thereon;

a second vertical support frame pivotally disposed endwise upon the rearward frame member of the base frame, said second vertical support frame moveable between a lowered position and an upright position releasably connectable to each of the pair of connect bars, said second vertical support frame comprising:

a third vertical member pivotally disposed endwise upon the base frame proximal juncture between the rearward frame member and one of the pair of parallel frame members;

a fourth vertical member pivotally disposed endwise upon the base frame proximal juncture between the rearward frame member and the other of the pair of parallel frame members;

a planar cross member disposed between said third and fourth vertical members in a position proximal the height of the leg support when the second vertical support member is moved to the upright position;

a posterior support member disposed upon the planar cross member, said posterior support member disposed to supportively contact the back of a patient supported between the first and second vertical support frames; and a shoulder support member disposed atop the second vertical support frame, said shoulder support extensible and positional to engage over the shoulders of a patient supported between the first and second vertical support frames;

wherein the second vertical support frame releasably secures in the upright position to supportively uphold a quadriplegic or paraplegic patient in an erect position upstanding for immersion in a body of water whereby hydrotherapy is treatable to said patient.

8. The quadriplegic and paraplegic patient hydrotherapy standing support immersion apparatus of claim 7 wherein the base frame is negatively buoyant.

9. The quadriplegic and paraplegic patient hydrotherapy standing support immersion apparatus of claim 8 wherein the shoulder support member is positively buoyant, whereby a patient's head is maintainable above a water surface.

* * * * *